United States Patent [19]

Tsuhara et al.

[11] Patent Number: 4,692,757

[45] Date of Patent: Sep. 8, 1987

[54] MULTIMEDIA DISPLAY SYSTEM

[75] Inventors: Susumu Tsuhara, Sagamihara; Kuniaki Tabata, Tokyo; Yasuyuki Okada, Sagamihara, all of Japan

[73] Assignee: Hitachi, Ltd., Tokyo, Japan

[21] Appl. No.: 564,496

[22] Filed: Dec. 22, 1983

[30] Foreign Application Priority Data

Dec. 24, 1982 [JP] Japan ..... 57-226120

[51] Int. Cl.[4] ..... G09G 1/16

[52] U.S. Cl. ..... 340/721; 340/723; 340/724; 340/748

[58] Field of Search ..... 340/721, 723, 724, 731, 340/750, 799, 745, 747, 748

[56] References Cited

U.S. PATENT DOCUMENTS 4,197,590 4/1980 Sukonick et al. ..... 340/721
4,278,973 7/1981 Hughes et al. ..... 340/721
4,470,042 9/1984 Barnich et al. ..... 340/721
4,503,427 3/1985 Iida ..... 340/723
4,533,910 8/1985 Sukonick et al. ..... 340/721
4,559,533 12/1985 Bass et al. ..... 340/721

*Primary Examiner*—Gerald L. Brigance
*Attorney, Agent, or Firm*—Antonelli, Terry & Wands

[57] ABSTRACT

A multimedia display system for efficiently and economically displaying document information containing characters, a graph and a picture image, without using a large-capacity image memory is disclosed in which information in a window is directly written in a bit-map memory or the display screen of a display device, without necessitating an image memory having a storage capacity corresponding to one page of a document. The multimedia display system is effectively used in the multiwindow display method, and includes a transfer controller for controlling data transfer between the bit-map memory and a memory device including a main memory, a picture image memory and a font memory, to control the size, position and contents of each window and to make possible image synthesis or image conversion.

4 Claims, 10 Drawing Figures

| WINDOW NUMBER | DISPLAY POSITION ON DISPLAY SCREEN | | SIZE | | LEVEL | DISPLAY REQUESTING FLAG | POSITION OF SELECTION IN DOCUMENT | | DOCUMENT'S NAME |
|---|---|---|---|---|---|---|---|---|---|
| | X-DIRECTION | Y-DIRECTION | X-DIRECTION | Y-DIRECTION | | | X-DIRECTION | Y-DIRECTION | |
| 0 | | | | | | | | | |
| 1 | | | | | | | | | |
| 2 | | | | | | | | | |
| ⋮ | | | | | | | | | |

| DOCUMENT'S NAME | LOCATION OF DOCUMENT FILE | |
|---|---|---|
| | STORAGE ADDRESS | DATA LENGTH |
| | | |
| | | |
| | | |

FIG. 7
| NAME OF COMMAND | FUNCTION |
|---|---|
| OPEN | PRODUCE WINDOW AND DISPLAY SPECIFIED DOCUMENT ON DISPLAY DEVICE |
| CLOSE | DELETE WINDOW |
| MOVE | CHANGE POSITION OF WINDOW ON DISPLAY SCREEN |
| GROW | ENLARE WINDOW |
| SHRINK | REDUCE WINDOW |
| PUSH | PLACE WINDOW BELOW ALL WINDOWS |
| POP | PLACE WINDOW ABOVE ALL WINDOWS |
| SCROLL | CHANGE POSITION OF SELECTION ON DOCUMENT |
FIG. 8
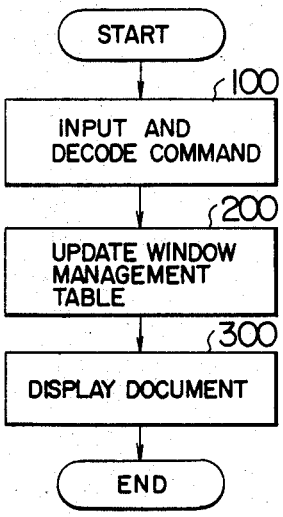
FIG. 9
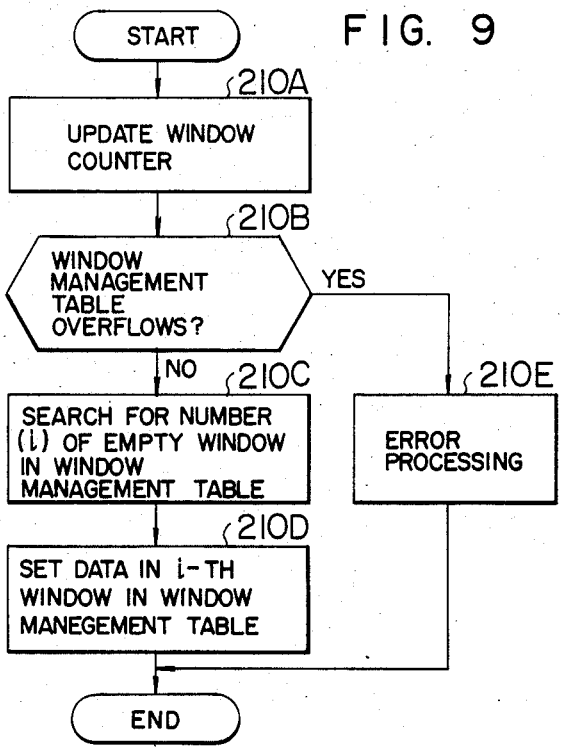

MULTIMEDIA DISPLAY SYSTEM

BACKGROUND OF THE INVENTION

1. Field of the Invention

The present invention relates to a display system for displaying multimedia document information containing a character, a graph, a picture image and the like (hereinafter simply referred to as "document information") on a display device, and more particularly to a display system suited for interactive document processing.

2. Description of the Prior Art

A conventional multimedia display system includes an image memory having a storage capacity corresponding to one page of a document, and the whole information, including characters, graphs and picture images written on one page, is stored in the image memory in the form of dot information. When characters, a graph and a picture image in a rectangular region (namely, a window) are to be displayed, dot information in the region is taken out of the image memory, and is transferred to a bit-map memory.

In the above system, the image memory is required to have a storage capacity of about 500 KB in order to be able to store therein information on one page of size A4, or to have a storage capacity of about 1 MB in order to be able to store therein information on one page of size A3. That is, an expensive memory is required.

SUMMARY OF THE INVENTION

An object of the present invention is to provide a multimedia display system which can efficiently and economically display document information containing characters, graphs and picture images, without using a large-capacity image memory.

In order to attain the above object, according to the present invention, there is provided a multimedia display system in which information in a window is not stored in an image memory having a storage capacity corresponding to one page of a document, but is directly written in a bit-map memory.

FIG. 1 is a diagrammatic view showing the fundamental thought of the present invention. Referring to FIG. 1, a document 1 contains character information 2, a graph 3 and a picture image 4. It will be needless to say that these different kinds of media may overlap each other. When information in a partial region (namely, a window) 5 of the document 1 is displayed, only document information in the window 5 is converted by a code/image converter 6 into dot information, which is directly written in a bit-map refresh memory 8 of a display device.

BRIEF DESCRIPTION OF THE DRAWINGS

FIG. 7 is a view for explaining some of commands used in the present invention.

FIG. 8 is a flow chart showing the processing procedure for each command.

FIG. 9 is a flow chart showing a procedure for updating a window management table.

DESCRIPTION OF THE PREFERRED EMBODIMENT

Figure 2:
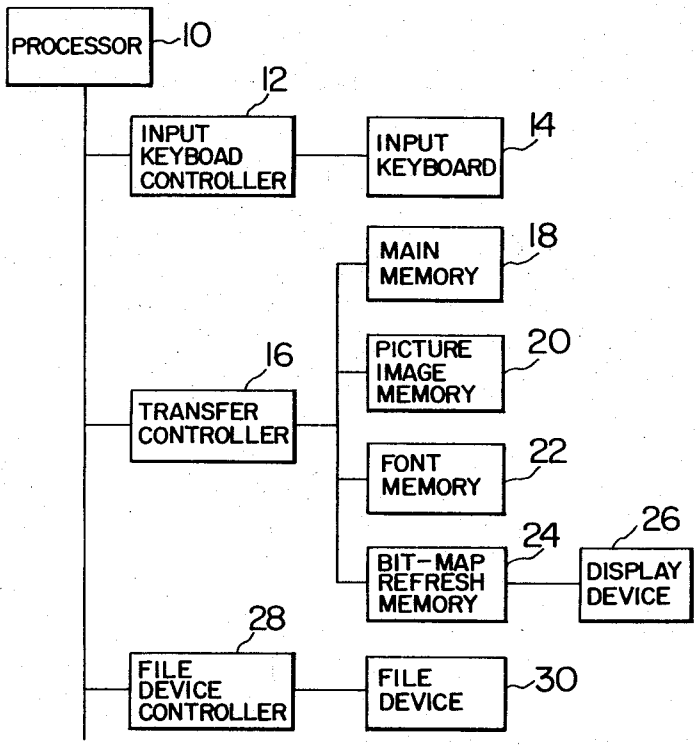
FIG. 2 is a block diagram showing the hardware of an embodiment of a multimedia display system according to the present invention.
Figure 1:
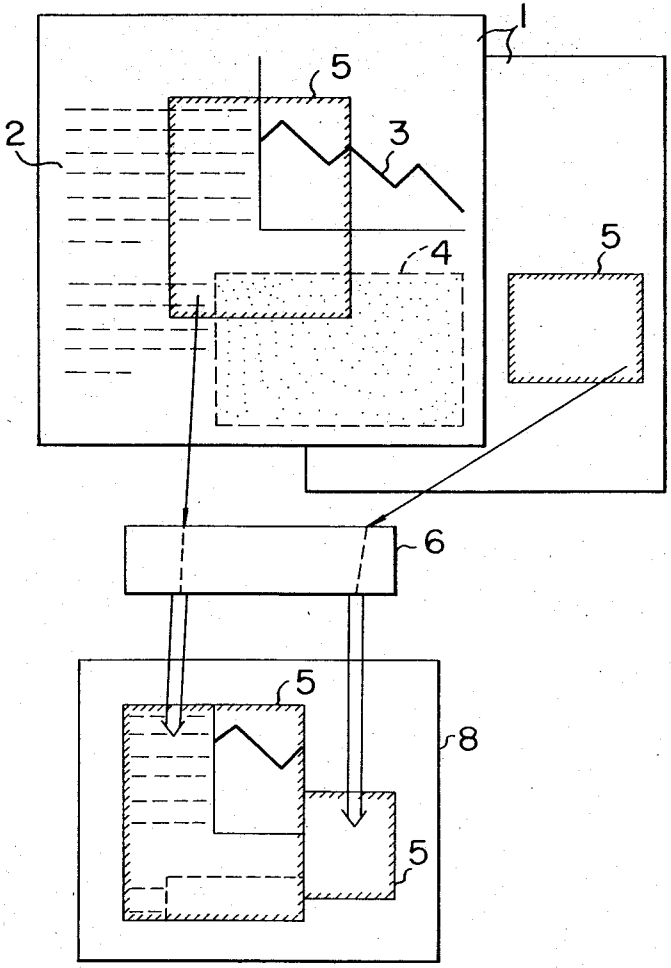
FIG. 1 is a diagrammatic view showing the fundamental thought of the present invention.

Now, explanation will be made of an embodiment of a multimedia display system according to the present invention, by reference to FIG. 2. In FIG. 2, reference numeral 10 designates a processor such as a microprocessor, 14 designates an input keyboard for inputting commands and parameters, 18 designates a main memory for storing therein programs and tables, 20 designates a picture image memory for temporarily storing therein picture image data, 22 designates a font memory for storing therein character fonts, 24 designates a bit-map refresh memory of a display device, 26 designates a display device, 30 designates a file device for storing therein document information, 12 designates an input-keyboard controller, 16 designates a transfer controller for controlling data transfer between memories, and 28 designates a file-device controller.

Figure 3:
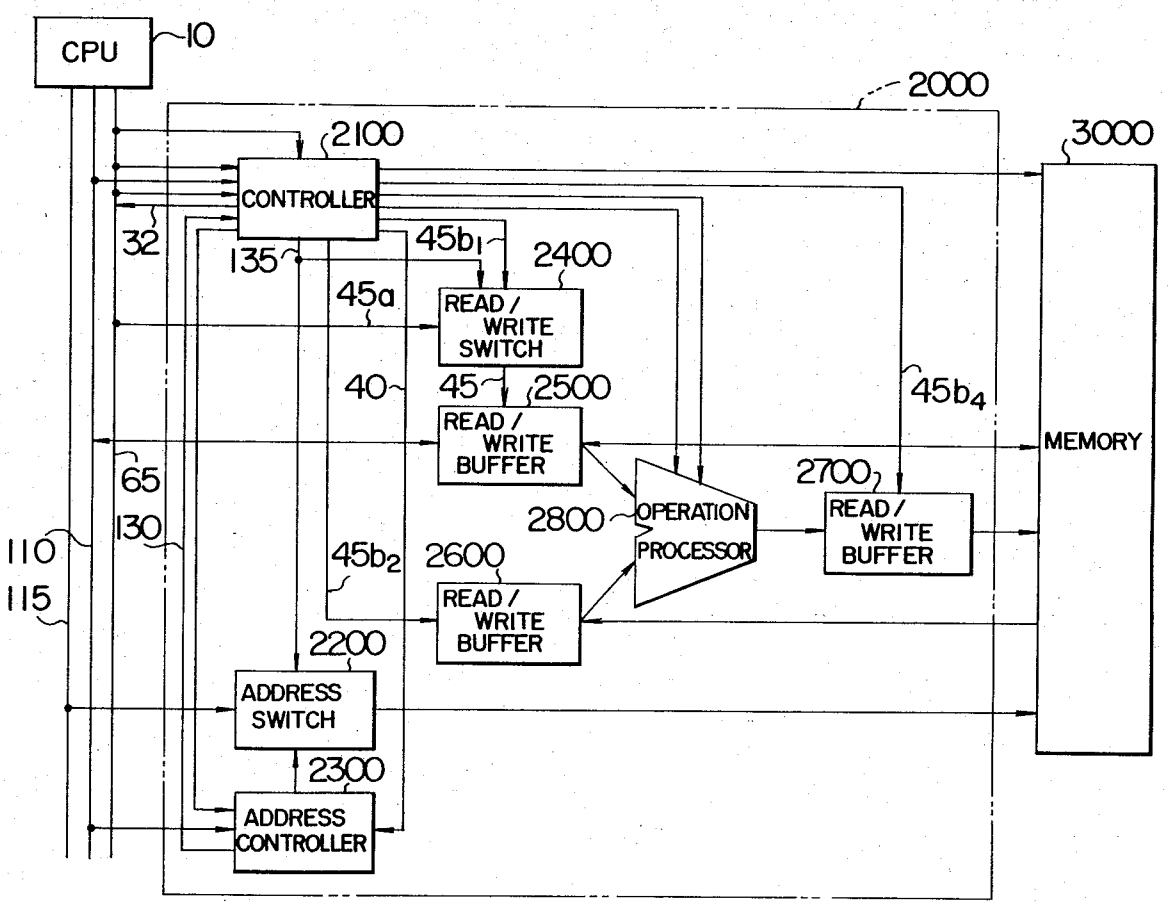
FIG. 3 is a block diagram showing the circuit configuration of an example of the transfer controller shown in FIG. 2.

The transfer controller 16 in the above embodiment may be formed of a device which is described in Japanese Patent Application No. 61075/1982. An example of such a device is shown in FIG. 3. Referring to FIG. 3, a block 2000 bounded by a broken line indicates a memory control device which is a main part of the transfer controller 16. The memory control device 2,000 is connected between a central processing unit (CPU) 10 and a memory 3,000, and is connected to the CPU 10 through an address bus 115, a data bus 110 and a control bus 65. In a multimedia display system according to the present invention, the memory 3,000 is used as a bit-map memory.

The memory control device 2,000 includes a controller 2,100, an address controller 2,300, an operation processor 2,800, a read/write switch 2,400, an address switch 2,200, and read/write buffers 2,500, 2,600 and 2,700.

The address switch 2,200 operates as follows. When a mode signal 135 delivered from the controller 2,100 indicates a first mode (in which the memory 3,000 is used as the main memory of the CPU 10), data supplied to the address switch 2,200 through the address bus 115 is sent, as address data, to the memory 3,000. When the mode signal 135 indicates a second mode (in which the memory 3,000 is used for processing a graph and a picture image), data supplied from the address controller 2,300 to the address switch 2,200 is sent, as address data, to the memory 3,000.

The read/write switch 2,400 operates as follows. When the mode signal 135 from the controller 2,100 indicates the first mode, a read/write signal 45*a* supplied to the switch 2,400 through a control bus 65 is sent to the read/write buffer 2,500. Then, for a reading operation, data is fetched from the memory 3,000 in the read/write buffer 2,500 at a first period of a timing signal, and the data thus fetched is sent to the CPU 10 at a second period of the timing signal. For a writing operation, the above processing is reversed, to send data from the CPU 10 to the memory 3,000 through the buffer 2,500. When the mode signal 135 indicates the second mode, a read signal 45$b_1$ supplied from the controller 2,100 to the read/write switch 2,400 is sent to the read/write buffer 2,500. Then, the read signal 45*b* issues a read command once every four periods of a synchronizing signal 40. That is, source data is fetched from the memory 3,000 in the read/write buffer 2,500 on the basis of the signal 45$b_1$ which is synchronized with a first period of the synchronizing signal 40. Destination data is fetched from the memory 3,000 in the read/write buffer 2,600 in synchronism with a signal 45$b_2$ which is generated at a second period of the synchronizing signal 40. A signal generated at a third period of the synchronizing signal 40 activates the operation processor 2,800 to perform a logical operation between the source data and destination data, and to send the result of the logical operation to the read/write buffer 2,700. In synchronism with a signal 45$b_4$ generated at a fourth period of the synchronizing signal 40, the contents of the read/write buffer 2,700 are sent not to the CPU 10 but to the memory 3,000. Thus, data can be transferred between the memory control device 2,000 and memory 3,000, without passing through the buses 65, 110 and 115.

The address controller 2,300 computes respective addresses of source and destination, when the second mode is carried out.

The memory control device 2,000 can generate a graph and can carry out image conversion, in accordance with the following procedure.

(1) Various parameters necessary for data transfer (namely, the head address $A_1$ of the source, the head address $A_2$ of the destination, the effective data length $l_1$ of the source, the effective data length $l_2$ of the destination, a number $N_1$ indicating how many times a source is accessed, a number $N_2$ indicating how many times a destination is accessed, the skip length $I_1$ of source address, the skip length $I_2$ of the destination address, the scanning direction $d_1$ of the source data, the scanning direction $d_2$ of the destination data, the reskipping direction $J_2$ of the destination address, and the kinds C of operation) are specified as follows. Specified values are set in registers which are included in the CPU 10, and then control signals each for specifying a corresponding parameter are sent to the memory control device 2,000. The controller 2,100 decodes each of the control signals, and generates an initial-value setting signal corresponding to each control signal. Thus, initial values are set in registers which are included in the controller 2,100, and in registers or counters which are included in the address controller 2,300.

(2) The CPU 10 sends out a control signal for starting the data transfer carried out in the second mode. Then, a synchronizing signal generator included in the controller 2,100 begins to operate, and sends the synchronizing signal 40 to the address controller 2,300. A series of operations are performed at four periods of the synchronizing signal 40. That is, a reading operation for source data, a reading operation for destination data, a logical operation between the source data and destination data, and a writing operation for writing the result of the logical operation in the destination, are performed at first, second, third and fourth periods of the synchronizing signal 40, respectively. Such a series of operations are repeated several times.

(3) When the above-mentioned data transfer is carried out $N_2$ times, which are specified, the address controller 2,300 sends an end signal 130 to the controller 2,100. On receiving the end signal 130, the controller 2,100 sends an end interruption to the CPU 10, to inform the CPU 10 that data transfer is completed.

Next, explanation will be made of the operations of various devices shown in FIG. 2. When the name of document information to be displayed on the display device 26 is specified by the input keyboard 14, the file device 30 is searched to find therein the document information corresponding to the specified name. The document information is usually formed of characters, graphs and picture images. Of the document information searched out in the file device 30, the character information and the graph information are stored in the main memory 18, while picture image information which includes dot patterns is stored in the picture image memory 20. As to characters, font patterns corresponding to characters which exist in a window are read out from the font memory 22, to be written in the refresh memory 24. As to graphs, only that portion of a graph which exists in the window is converted by the well-known clipping algorithm into a dot pattern, which is written in the refresh memory 24. An example of the operation for writing a graph in a refresh memory in the form of a dot pattern is described in the previously-referred to Japanese patent application No. 61075/1982. As to picture images, only that portion of a dot pattern for a picture image which exists in the window is read out from the file device 30, and is written in the refresh memory 24. That is, in the refresh memory 24, a single image data is edited from document information which is obtained from a window and is formed of data with respect to characters, graphs and picture images.

Figures 4, 5, 6:
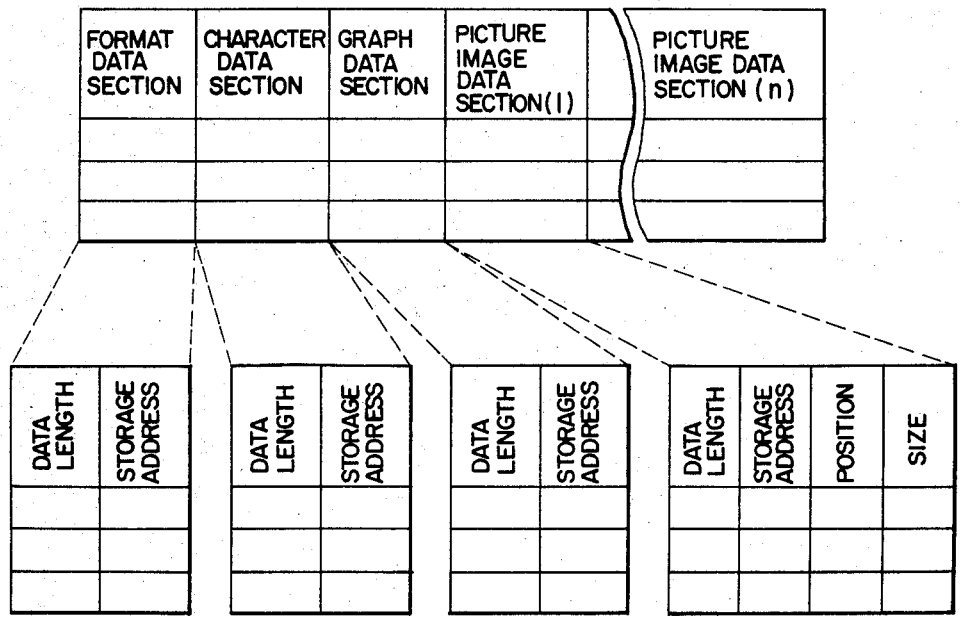
FIG. 4 is a view for explaining a window management table.
FIG. 5 is a view for explaining a search table.
FIG. 6 is a view for explaining the inner structure of a document file device.

In order to define a window arrangement on the display screen of the display device 26, a window management table such as shown in FIG. 4 is provided in the main memory 18. The window management table defines not only the position and size of each window on the display screen but also the position where each partial region is selected from a document. Each partial region is made equal in size to a corresponding one of the windows. The position of each window on the display screen is expressed by a coordinate system having its origin at the upper left corner of the display screen, and the position where each partial region is selected from the document is expressed by a coordinate system having its origin at the upper left corner of the document.

A search table such as shown in FIG. 5 is also provided in the main memory 18. In order to select desired document information from document information stored in the file device 30, the search table indicates the position of document information corresponding to a document's name, that is, a storage address and data length corresponding to a document's name. As shown in FIG. 6, the document information stored in the file device 30 includes format data, character data, graph data and picture image data. The format data specifies the format of a document, such as the character pitches in the longitudinal and transverse directions (namely, the distance between rows and the distance between columns), and top, bottom, left and right margins. The character data for forming a main part of a document is stored in the file device 30 in the form of a string of character codes. The graph data is stored in the form of a train of data which indicates the kind of curve, the thickness of the curve, and the X- and Y-coordinates of each of the starting and end points of the curve. The picture image data includes the attributes of a picture image, such as the size of the picture image, data length, and the position of the picture image on a document, and includes data values for indicating the degree of light and shade at each picture element.

The present invention is applicable to interactive document processing and the like. FIG. 7 shows some of the commands used in the present invention. When these commands are inputted by the input keyboard 14 together with needed parameters, a program stored in the processor 10 decodes the commands, and executes them in accordance with a processing procedure shown in FIG. 8. Referring to FIG. 8, the commands from the input keyboard 14 are taken in the processor 10, to be decoded (step 100). In step 200, the contents of the window management table are updated in accordance with each command. In step 300, predetermined document information is displayed on a predetermined window, by reference to the window management table and search table. Though the processing in steps 100 and 200 is described in detail in U.S. patent application Ser. No. 443872 (corresponding to Japanese Patent Application No. 189329/1981), the above processing will be briefly explained below.

(i) In step 100 for inputting and decoding commands, the position (X- and Y-directions) and size (X- and Y-directions) of a window which is to be produced, on the display screen are specified by the input keyboard, and these data are taken in the processor 10.

(ii) In step 200 for updating the window management table, the processing shown in FIG. 9 is carried out to produce a window. In step 210A, the contents WC of a window counter, which is provided in the processor 10 to indicate the number of windows having been produced on the display screen, are increased by one. Since the number of windows capable of entering the window management table (shown in FIG. 4) is limited, it is checked in step 210B whether the number of windows exceeds an upper limit or not. When the contents WC of the window counter exceed the above upper limit, the window management table overflows, and therefore error processing, such as sending an alarm message to the display device, is carried out in step 210E. When the window management table does not overflow, an unused (or empty) entry space exists in the window management table, and the window management table is searched to find out the unused entry space (step 210C). The flag in each entry space indicates whether an entry space has been used or not. When the i-th entry space is empty, that is, a flag $F_i$ indicates "0", data necessary to produce the i-th window is written in the i-th entry space (step 210D). That is, data indicated by the input keyboard (namely, the position and size of a window) are entered, as the attributes of the i-th window (namely, the X-address $X_i$, Y-address $Y_i$, width $S_i$ of window, and height $H_i$ of window), in the window management table. The item "level" in the window management table indicates an overlapping relation between windows, at the display screen. That is, when a window with a high level and another window with a low level have a display position in common, the former is displayed on the latter. Further, the level of a newly produced window is made higher than those of windows having been already produced. The level $L_i$ of the i-th window which is newly produced, is determined on the basis of a relation $L_i = WC - 1$. For example, in the case where only the i-th window exists, the value WC is equal to 1 and therefore the level $L_i$ is equal to zero. In the case where only one window exists in addition to the i-th window, $WC = 2$ and $L_i = 1$. The level of a window is determined in the above-mentioned manner, in order to be able to readily execute two commands ("POP" and "PUSH") for changing the overlapping state of windows. At a time when the i-th window is produced as above, image data to be displayed on the i-th window is not yet entered in the window management table. The following processing is carried out to produce the i-th window completely. In order that the i-th window contains a specified pattern (for example, a white or black area all over the window, or a checkerboard pattern), the name $D_1$ of the image data for producing the specified pattern is written in the window management table. When the name $D_1$ has been written, the flag $F_i$ in the window management table is set to "1", to indicate that the i-th window has been produced.

Figure 10:
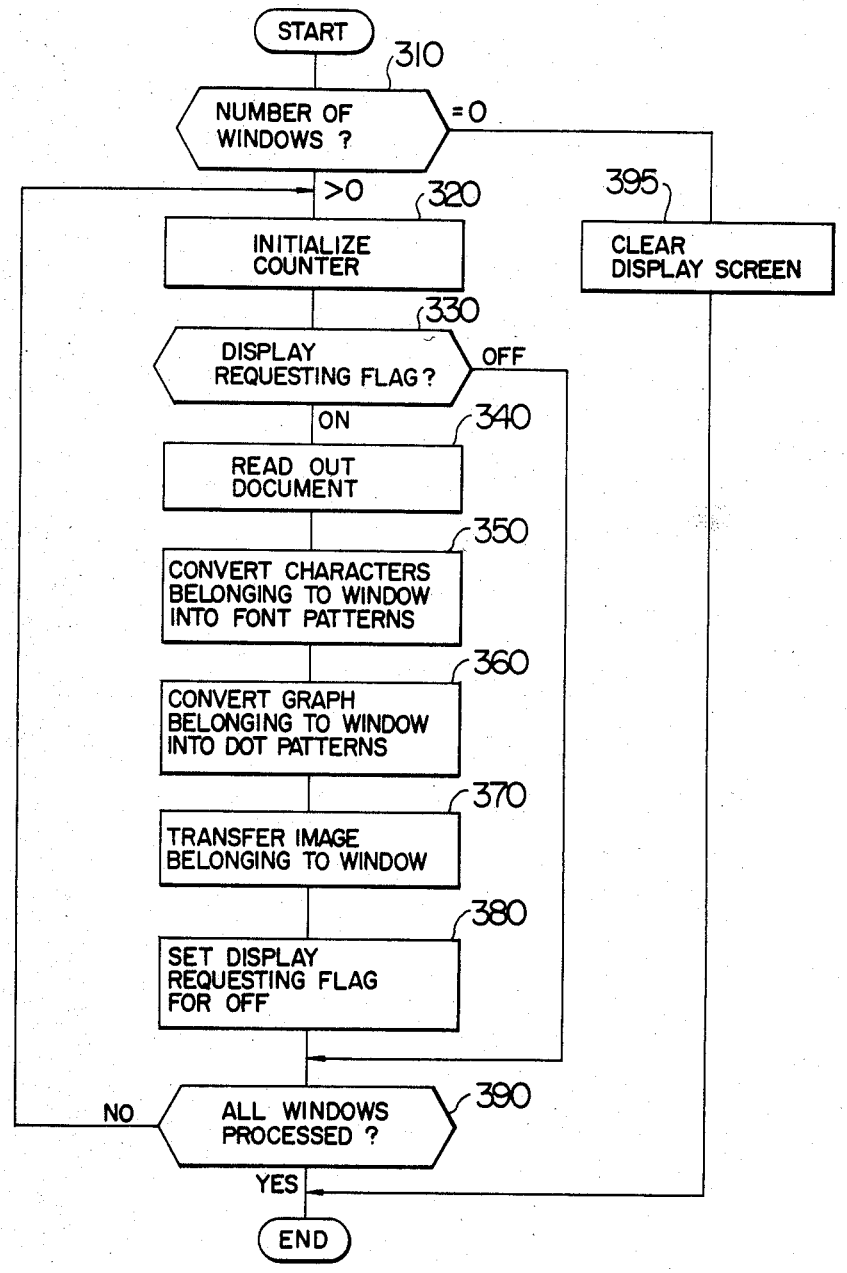
FIG. 10 is a flow chart showing in detail the procedure of the document display processing shown in FIG. 8.

Next, the processing procedure of step 300 shown in FIG. 8 will be explained below in detail, with reference to FIG. 10. A window with the lowest level is first processed, and all of the windows entered in the window management table are processed in the order of increasing level. Image data having been supplied to the refresh memory 24 before a command is inputted, is held in the memory 24. When the command is inputted, the refresh memory is required to be rewritten for a window, and is not required to be rewritten for another window. In order to discriminate between these windows, an item "display requesting flag" is provided on the window management table. The display requesting flag is set to "ON" or "OFF" in accordance with each command in step 200 of FIG. 8. When the flag is "OFF", a window having this flag is not required to be rewritten, but the next window is processed. When the flag is "ON", the search table is searched on the basis of the name of a document to be displayed on a window with this flag, to find out the position of the document in the file device 30. Desired document information (having the contents shown in FIG. 6) is fetched from the file device 30 in the main memory 18 (step 340). The document is usually formed of characters, graphs and picture images.

Of the fetched information, only data with respect to those portions of characters and graphs which exist in the window are selectively taken out and converted into dot patterns. The dot patterns thus obtained are written in predetermined areas in the refresh memory 24 (steps 350 and 360). On the other hand, the picture image data with respect to that portion which exists in the window is selected from the picture image memory 20 and transferred to other predetermined areas in the refresh memory (step 370).

As has been explained in the foregoing, according to the present invention, an image memory having a storage capacity corresponding to one page of a document (that is, an image memory having a storage capacity of about 500 KB for storing therein information on one page of size A4 or an image memory having a storage capacity of about 1 MB for storing therein information on one page of size A3) is not required, but an inexpensive image memory can be used.

We claim:

1. A system for displaying at least one specified partial region of a page of a document information, comprising:

display means having a screen for displaying a frame of information;

file means for storing therein a plurality of pages of document information, including character information and picture image information, said character information containing coded data, while said picture image information contains dot data;

first memory means for temporarily storing therein a page of document information including character information and picture image information read out from said file means;

second memory means for storing therein a frame of information in the form of dot patterns to be supplied to said display means for display on said screen;

means for specifying at least one page of said document information stored in said file means and at least one partial region of said specified page of said document information;

controlling means responsive to said specifying means for reading out said specified page of said document information from said file means, for storing the read-out page of document information in said first memory means and for extracting therefrom that portion of the character information and that portion of the picture image information which exist in said specified partial region of said specified page of said document information;

means for converting only said extracted portion of the character information to dot patterns and for storing the dot patterns obtained by said conversion in said second memory means; and means for storing said extracted portion of the picture image information in said second memory means.

2. A system according to claim 1, wherein said first memory means includes means for storing therein a window management table having data indicating at least the relationships between partial regions of pages of said document information and corresponding window regions specified on the screen of said display means for said partial regions and the relationships between the said window regions, said controller means including means responsive to the data in said window management table for effecting said extraction of said portions of said character information and picture image information.

3. A system according to claim 2, in which at least one of said pages of said document information stored in said file means includes graph information containing coded data, and said controller means includes means for extracting that portion of said graph information which exists in said specified partial region, for converting the extracted portion of the graph information to dot patterns and for storing the dot patterns obtained by said conversion in said second memory means.

4. A system according to claim 1, in which at least one of said pages of said document information stored in said file means includes graph information containing coded data, and said controller means includes means for extracting that portion of said graph information which exists in said specified partial region, for converting the extracted portion of the graph information to dot patterns and for storing the dot patterns obtained by said conversion in said second memory means.

* * * * *